US011008155B2

(12) United States Patent
Abe et al.

(10) Patent No.: US 11,008,155 B2
(45) Date of Patent: May 18, 2021

(54) DOUBLE-WALLED CONTAINER

(71) Applicants: Takayuki Abe, Tokyo (JP); Mitsuo Furusawa, Tokyo (JP)

(72) Inventors: Takayuki Abe, Tokyo (JP); Mitsuo Furusawa, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 1114 days.

(21) Appl. No.: 14/780,883

(22) PCT Filed: Mar. 28, 2014

(86) PCT No.: PCT/JP2014/001854
§ 371 (c)(1),
(2) Date: Sep. 28, 2015

(87) PCT Pub. No.: WO2014/156197
PCT Pub. Date: Oct. 2, 2014

(65) Prior Publication Data

US 2016/0083169 A1 Mar. 24, 2016

(30) Foreign Application Priority Data

Mar. 29, 2013 (JP) ..... JP2013-074263
May 31, 2013 (JP) ..... JP2013-116422

(51) Int. Cl.
*B65D 83/00* (2006.01)
*A45D 40/00* (2006.01)
(Continued)

(52) U.S. Cl.
CPC ..... *B65D 83/0055* (2013.01); *A45D 40/00* (2013.01); *B65D 21/08* (2013.01); *B65D 47/0842* (2013.01); *B65D 49/02* (2013.01)

(58) Field of Classification Search
CPC ..... B65D 83/0055; B65D 21/08; B65D 47/0842; B65D 1/02; B65D 49/02; A45D 40/00
(Continued)

(56) References Cited

U.S. PATENT DOCUMENTS 774,834 A 11/1904 Delafield
784,656 A 3/1905 Brent, Jr.
2006/0065673 A1 3/2006 Miyazaki et al.

FOREIGN PATENT DOCUMENTS

CN 1671603 A 9/2005
EP 1 593 605 A1 11/2005
(Continued)

OTHER PUBLICATIONS

Sep. 29, 2015 International Preliminary Report on Patentability issued in International Patent Application No. PCT/JP2014/001854.
(Continued)

*Primary Examiner* — Andrew D Perreault
(74) *Attorney, Agent, or Firm* — Oliff PLC

(57) ABSTRACT

A double container includes an outer layer body constituting an outer shell; an inner layer body including an upper opening communicating with a containing space, accommodated in the outer layer body, and deformable to undergo volume reduction; an inside plug including a tubular wall extending toward the containing space, a spherical body serving as a valve body being disposed inside the tubular wall; and a dispensing plug fitted to a mouth portion of the outer layer body and including a dispensing tube connected to the tubular wall. The tubular wall includes an inclined wall having a diameter decreasing toward the containing space and configured to abut against the spherical body over an entire circumference and including a protruding wall protruding from the inclined wall to the containing space. The protruding wall includes a liquid holding member
(Continued)

holding a pool of liquid medium of the content formed below the spherical body.

5 Claims, 5 Drawing Sheets

(51) Int. Cl.
*B65D 21/08* (2006.01)
*B65D 47/08* (2006.01)
*B65D 49/02* (2006.01)

(58) Field of Classification Search
USPC ..... 206/219; 215/27; 222/494, 212, 213, 222/386, 386.5, 491
See application file for complete search history.

(56) References Cited

FOREIGN PATENT DOCUMENTS

| | | | |
|---|---|---|---|
| EP | 3015383 | A1 | 5/2016 |
| JP | S63-98776 | U | 6/1988 |
| JP | H06-7824 | Y2 | 3/1994 |
| JP | 2001-063746 | A | 3/2001 |
| JP | 2004-149215 | A | 5/2004 |
| JP | 2011-073770 | A | 4/2011 |
| JP | 2013-005947 | A | 1/2013 |
| KR | 200425347 | Y1 | 9/2006 |

OTHER PUBLICATIONS

Feb. 23, 2016 Office Action issued in Australian Patent Application No. 2014245571.
May 25, 2016 Office Action issued in Chinese Patent Application No. 201480019081.8.
Aug. 11, 2016 Office Action issued in Korean Patent Application No. 10-2015-7026761.
Oct. 14, 2016 Search Report issued in European Patent Application No. 14776133.2.
Nov. 23, 2016 Office Action issued in Chinese Patent Application No. 201480019081.8.
Sep. 20, 2016 Office Action issued in Japanese Patent Application No. 2013-116422.
Dec. 8, 2016 Office Action issued in Canadian Patent Application No. 2,908,135.
Jul. 8, 2014 International Search Report issued in International Patent Application No. PCT/JP2014/001854.
Mar. 30, 2016 Office Action issued in Singaporean Patent Application No. 11201508048U.
Feb. 17, 2017 Office Action issued in Korean Application No. 10-2015-7026761.
Apr. 19, 2017 Office Action issued in Korean Application No. 10-2015-7026761.
Aug. 27, 2018 Office Action issued in Indonesian Application No. P00201507000.

A-arrow view

DOUBLE-WALLED CONTAINER

TECHNICAL FIELD

The present disclosure relates to a double-walled container (hereinafter, called double container) including an outer layer body that constitutes an outer shell of the container and an inner layer body that is accommodated in the outer layer body and that is deformable to undergo volume reduction. In the double container, only the inner layer body undergoes volume reduction in response to dispensing of a content.

BACKGROUND

As a container for containing cosmetics such as face lotion, shampoo, rinse, liquid soap, food seasoning, or the like, a double container (which is also called delamination container) including an outer layer body that constitutes an outer shell of the container and an inner layer body that is accommodated in the inner layer body and that is deformable to undergo volume reduction has been known. In such a double container, an ambient air introducing hole is provided in communication between the inside and the outside of the outer layer body, and only the inner layer body undergoes volume reduction in response to dispensing of the content.

Ways of dispensing the content include using a pump fitted to a mouth portion of the outer layer body and squeezing a trunk portion of the outer layer body. Another possible way that may be adopted when the content has a relatively low viscosity is to tilt or invert the container and allows the content to be dispensed by its own weight. In connection with this, Patent Literature 1 discloses a double container in which a spherical body (ball valve) is disposed in a dispensing plug that is fitted to a mouth portion of the container, the spherical body being displaceable by its own weight in response to a change in position of the container. When the container is in an upright position, the spherical body is in abutment with an inclined wall of the dispensing plug, thereby preventing ambient air from entering a containing space of a content. On the other hand, when the container is brought into a tilted or an inverted position, the spherical body is displaced off the inclined wall of the dispensing plug, thereby allowing the content to be dispensed by its own weight.

CITATION LIST

Patent Literature

PTL 1: JP2011073770A

SUMMARY

Technical Problem

When the container is returned to the upright position after the dispensing of the content, as illustrated in FIG. 4A, a pool of the liquid medium is formed below the spherical body B due to surface tension, and the pool of the liquid medium serves to prevent drying of an abutting surface between the spherical body and the inclined wall. However, when transportation, vibration, or the like of the container causes a slight impact to the pool of the liquid medium, as illustrated in FIG. 4B, a portion or an entirety of the pool of the liquid medium might drip. As time elapses in such situations, the content adhered to the spherical body and the inclined wall might be exposed to air and dried. This might result in a failure in displacement of the spherical body or a decrease in sealing performance in the abutting surface. In view of the above, improvement is needed for holding the pool of the liquid medium in a more stable manner.

The present disclosure is to solve the conventional problem and to provide a novel double container that is capable of holding the pool of the liquid medium more stably in order to prevent dripping of the pool of the liquid medium formed below the spherical body.

Solution to Problem

In at least one aspect, one of embodiments of the present disclosure resides in a double container, including:

an outer layer body constituting an outer shell of the double container; an inner layer body that includes an upper opening communicating with a containing space of a content, that is accommodated in the outer layer body, and that is deformable to undergo volume reduction; an inside plug that is located in the upper opening and that includes a tubular wall extending toward the containing space, a spherical body serving as a valve body being disposed inside the tubular wall; and a dispensing plug that is fitted to a mouth portion of the outer layer body to cover the inside plug and that includes a dispensing tube connected to the tubular wall, wherein the tubular wall includes an inclined wall that has a diameter decreasing toward the containing space and that is configured to abut against the spherical body over an entire circumference and also includes a protruding wall protruding from the inclined wall to the containing space, and the protruding wall includes a liquid holding member configured to hold a pool of a liquid medium of the content formed below the spherical body.

According to a preferred embodiment, the liquid holding member includes at least one rib extending from the protruding wall to the containing space.

According to another preferred embodiment, the rib is provided in plurality, and the plurality of ribs are arranged at an equal interval in a circumferential direction of the tubular wall.

According to yet another preferred embodiment, the liquid holding member includes a stepped portion provided on an inner circumferential surface of the protruding wall.

According to yet another preferred embodiment, the stepped portion has an annular or a helical shape extending in a circumferential direction of the protruding wall. According to yet another preferred embodiment, the stepped portion is provided intermittently in a circumferential direction of the protruding wall.

Advantageous Effect

The tubular wall of the inside plug includes the inclined wall that is configured to abut against the spherical body, which serves as the valve body, over the entire circumference and also includes the protruding wall protruding from the inclined wall to the containing space, and moreover, the liquid holding member configured to hold the pool of the liquid medium of the content formed below the spherical body is provided. Accordingly, even when a slight impact is applied to the pool of the liquid medium, the pool of the liquid medium is held more stably. The liquid holding member herein may refer to the at least one rib extending from the protruding wall to the containing space or the stepped portion provided on the inner circumferential surface of the protruding wall.

When the rib is provided, motion of the pool of the liquid medium like a swinging pendulum is hindered, and when the stepped portion is provided, the stepped portion may be designed to "catch" the pool of the liquid medium, and therefore, the pool of the liquid medium is held stably.

When the rib is provided in plurality, and the plurality of ribs are arranged at the equal interval in the circumferential direction of the tubular wall, motion of the pool of the liquid medium is hindered evenly over the entire circumference thereof, and accordingly, the pool of the liquid medium is held even more stably.

When the stepped portion is formed in the annular or the helical shape extending in the circumferential direction of the protruding wall or when the stepped portion is provided intermittently in the circumferential direction of the protruding wall, the "catching" effect spreads over the entire circumference of the pool of the liquid medium. As a result, the pool of the liquid medium is held even more stably.

DETAILED DESCRIPTION

Some embodiments of the present disclosure will be described in more detail below with reference to the drawings.

Figure 1A:
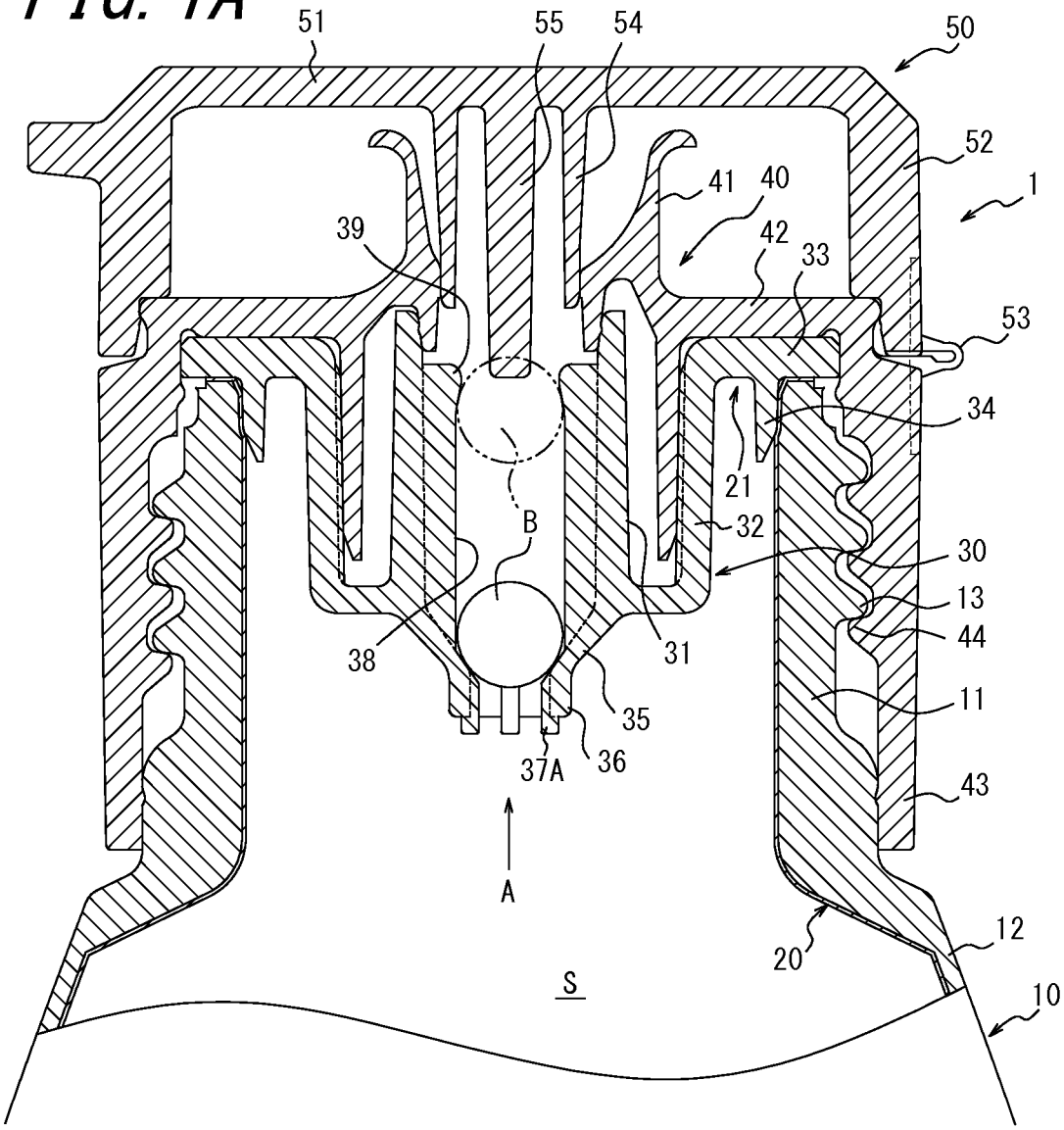
FIG. 1A is a sectional view of a portion of a double container according to one of embodiments of the present disclosure.
Figure 1B:
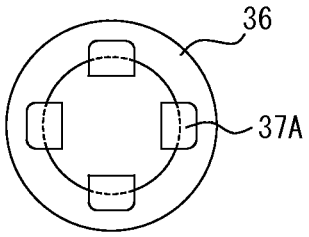
FIG. 1B is an arrow view taken in the direction of an arrow A in FIG. 1A.
Figure 2:
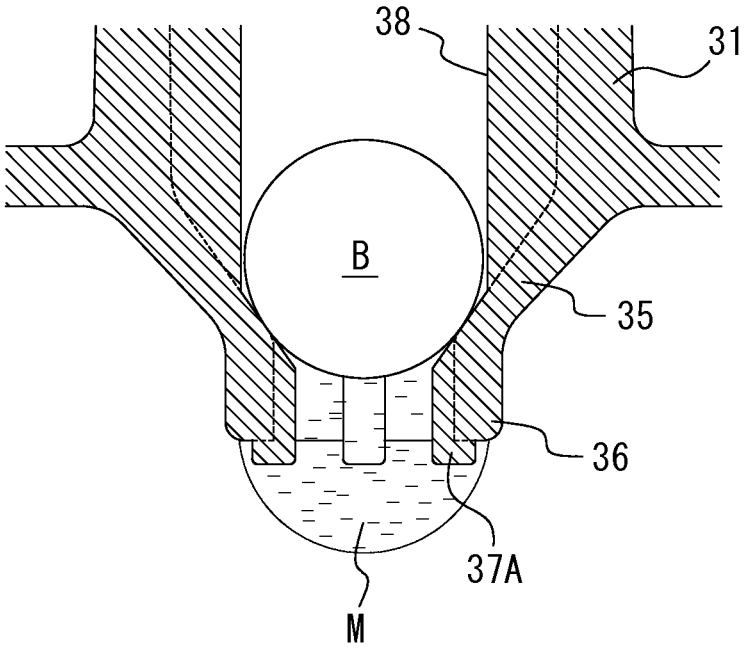
FIG. 2 illustrates a pool of a liquid medium formed in the double container in FIG. 1A.

FIG. 1A is a sectional view of a portion of a double container according to one of embodiments of the present disclosure, and FIG. 1B is an arrow view taken in the direction of an arrow A in FIG. 1A. FIG. 2 illustrates a pool of a liquid medium formed in the double container in FIG. 1A.

In FIG. 1A, reference numeral 1 denotes a double container according to one of embodiments of the present disclosure. The double container 1 includes an outer layer body 10 constituting an outer shell and an inner layer body 20 accommodated in the outer layer body 10. The double container 1 also includes, in an upper portion thereof, an inside plug 30, a dispensing plug 40, and a cap body 50. The double container 1 in the present embodiment has a laminated structure with the outer layer body 10 and the inner layer body 20 which are made of relatively incompatible synthetic resins, and the double container 1 is obtained by blow molding a parison prepared by laminating these synthetic resin materials. Furthermore, although not illustrated, a single bonding strip extending vertically between the outer layer body 10 and the inner layer body 20 is provided for partially bonding the outer layer body 10 to the inner layer body 20 in the present embodiment. The bonding strip may be provided as needed, and the bonding strip may also be omitted or provided in plurality.

The outer layer body 10 is flexible and restorable and includes a cylindrical mouth portion 11, a trunk portion 12 connected to the mouth portion 11, and a bottom portion (which is not illustrated) connected to the trunk portion 12. The mouth portion 11 has an outer circumferential surface provided with a male screw portion 13. Although not illustrated, an ambient air introducing hole extending through the outer layer body 10 is also formed in the outer layer 10. The ambient air introducing hole may be formed by utilizing a slit in a pinch-off portion formed in the bottom portion at the time of blow molding or may be formed in the mouth portion 11 or trunk portion 12 by post processing after blow molding.

The inner layer body 20 defines, inside thereof, a containing space S which may be filled with a content, and the inner layer body 20 also includes an upper opening 21 communicating with the containing space S. The inner layer body 20 may be peeled from the laminated outer layer body 10 and deformed to undergo volume reduction.

The inside plug 30 is located in the upper opening 21 of the inner layer body 20, and as illustrated in FIG. 1A, the inside plug 30 includes a tubular wall 31 standing in a middle portion of the upper opening 21. The inside plug 30 also includes an annular wall 32 located radially outward from the tubular wall 31 via a flange connected to a lower portion of the tubular wall 31. Furthermore, the inside plug 30 includes a flange portion 33 located in an upper end edge portion of the annular wall 32 and extending radially outward to abut against an upper end of the mouth portion 11 (with or without the inner layer body 20 being sandwiched between the flange portion 33 and the upper end of the mouth portion 11). The flange portion 33 has a lower surface provided with an annular sealing wall 34 configured to abut against the outer layer body 10 with the inner layer body 20 being sandwiched therebetween. Moreover, the tubular wall 31 includes, in a lower end portion (which is an end portion located closer to the containing space S) of the tubular wall 31, an inclined wall 35 having a diameter decreasing toward the containing space S. In a lower end portion (which is an end portion located closer to the containing space S) of the inclined wall 35, the tubular wall 31 also includes a cylindrical protruding wall 36 extending concentrically with the tubular wall 31. The protruding wall 36 may also have a square tubular shape. The protruding wall 36 is provided, as a liquid holding member, with a rib 37A that has an upper end surface connected to an upper surface of the inclined wall 35 and that protrudes radially inward from an inner circumferential surface of the protruding wall 36 and also extends downward toward the containing space S. Herein, as illustrated in FIG. 1B, the rib 37A in the present embodiment has substantially a rectangular shape in a transverse section thereof. A total of four ribs 37A are provided at an equal interval in a circumferential direction of the protruding wall 36, that is to say, in a circumferential direction of the tubular wall 31. The shape of each rib 37A is not limited to the illustrated example, and the rib 37A in its transverse section may have a polygonal shape such as a triangular or a pentagonal shape, or a circular shape. Moreover, the tubular wall 31 includes, on an inner circumferential surface of the tubular wall 31, a plurality of longitudinal ribs 38 located at an interval in the circumferential direction. The longitudinal ribs 38 are each provided, in an upper portion thereof, with a convex portion 39 protruding radially inward.

Besides, a spherical body B (which is made of a synthetic resin in the present embodiment, although the spherical body B may be made of a metal or a synthetic resin) is disposed on an inner side of the longitudinal ribs 38 in the radial direction. The spherical body B may be displaced by its own weight along the longitudinal ribs 38 in accordance with a change in position of the double container 1, and as illustrated in FIG. 1A, when the double container 1 is in an upright position, the spherical body B is in abutment against the inclined wall 35 over the entire circumference to close the containing space S of the inner layer body 20. The aforementioned convex portion 39 serves to prevent the spherical body B from slipping off upward.

The dispensing plug 40 includes a dispensing tube 41 that is connected to the tubular wall 31, that has a diameter increasing upward, and that has an upper end curved radially outward to form a lip. The dispensing tube 41 extends radially outward to be connected to a ceiling wall 42 located above the flange portion 33. The ceiling wall 42 has an edge portion, to which an outer circumferential wall 43 surrounding the mouth portion 11 is connected. The outer circumferential wall 43 has an inner circumferential surface provided with a female screw portion 44 corresponding to the male screw portion 13 provided in the mouth portion 11. With the above structure, the dispensing plug 40 is screw fastened to the mouth portion 11 with the inside plug 30 being sandwiched therebetween. Additionally, the dispensing plug 40 may also be fitted to the mouth portion 11 by utilizing an undercut.

The cap body 50 includes a top wall 51 that covers the dispensing plug 40, a circumferential wall 52 that is connected to an edge portion of the top wall 51, and a hinge 53 that connects the circumferential wall 52 to the outer circumferential wall 43. The hinge 53 may be omitted, and the cap body 50 may be screw fastened to the dispensing plug 40. The top wall 51 is provided, in a lower surface thereof, with a sealing tube 54 configured to abut against an inner circumferential surface of the dispensing tube 41 in a liquid tight manner. The top wall 51 is also provided, in a portion thereof located radially inward from the sealing tube 54, with a pin 55 extending downward. The pin 55 is designed to abut against the spherical body B before the spherical body B, when being displaced upward, reaches the upper limit. This prevents the spherical body B from being displaced over the convex portion 39 provided in each longitudinal rib and disengaged even when the spherical body B is displaced upward forcibly due to transportation or the like.

To dispense the content from the double container 1 with the above structure, the cap body 50 is opened, and the double container 1 is brought into a tilted or an inverted position. By doing so, the spherical body B is displaced toward the dispensing tube 41, and the content contained in the containing space S is introduced into the tubular wall 31 through an opening of the protruding wall 36 by its own weight, passes between adjacent longitudinal ribs 38, and is dispensed from the dispensing tube 41. At this time, ambient air is introduced between the outer layer body 10 and the inner layer body 20 through the aforementioned ambient air introducing hole, and accordingly, only the inner layer body 20 undergoes volume reduction while the outer layer body 10 maintains its shape.

When the double container 1 is returned to the upright position after the dispensing of the content, the spherical body B is displaced toward the containing space S. Although a majority of the content contained in the tubular wall 31 is returned to the containing space S, as illustrated in FIG. 2, a portion of the content forms a pool of the liquid medium M below the spherical body B due to surface tension. In the present embodiment, even when transportation or the like of the double container 1 causes a slight impact to the pool of the liquid medium, the ribs 37A prevent the pool of the liquid medium M from swinging about the protruding wall 36, thereby hindering motion of the pool of the liquid medium M. Accordingly, the pool of the liquid medium M is held more stably. Especially when, as in the present embodiment, the ribs 37A are arranged at an equal interval in the circumferential direction of the tubular wall 31, motion of the pool of the liquid medium M is hindered evenly over the entire circumference thereof, and accordingly, the pool of the liquid medium M is held even more stably.

Figure 3A:
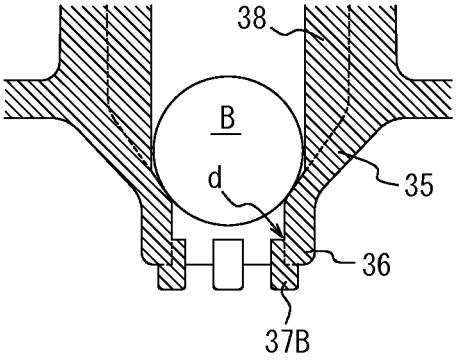
FIG. 3A is a partially enlarged sectional view of a double container according to another embodiment of the present disclosure.

Examples of the liquid holding member, other than the rib 37A illustrated in FIGS. 1A, 1B, and 2, include a rib 37B as illustrated in FIG. 3A. The rib 37B has an upper end surface located at a distance from the upper surface of the inclined wall 35, protrudes radially inward from the inner circumferential surface of the protruding wall 36, and extends downward toward the containing space S.

Figure 3B:
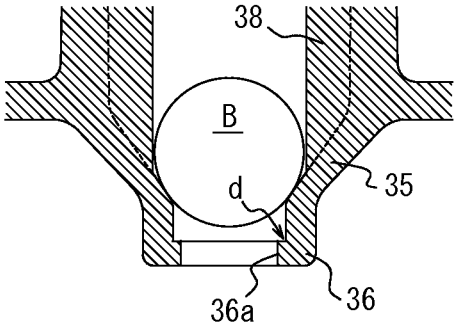
FIG. 3B is a partially enlarged sectional view of a double container according to yet another embodiment of the present disclosure.

Furthermore, as illustrated in FIG. 3B, there may be provided a protrusion 36*a* that protrudes radially inward from a lower end of the inner circumferential surface of the protruding wall 36 so that the protrusion 36*a* in a longitudinal section thereof has a rectangular shape, and a stepped portion d formed by the inner circumferential surface of the protruding wall 36 and the protrusion 36*a* may serve as the liquid holding member. In this case, the stepped portion d is designed to "catch" the pool of the liquid medium, and therefore, the pool of the liquid medium is prevented from dripping and held stably. Especially when the protrusion 36*a* is provided annually in the circumferential direction of the protruding wall 36 (this means that the stepped portion d is also provided annually) as illustrated in the figure, the "catching" effect spreads over the entire circumference of the pool of the liquid medium. As a result, the pool of the liquid medium is further prevented from dripping. Additionally, the protrusion 36*a* may be provided continuously in the circumferential direction as illustrated in the figure or, as illustrated, for example, by a protrusion 36*d* in FIG. 3F, may be provided intermittently (this means that the stepped portion is also provided intermittently) by cutting out some portions. Although three protrusions 36*d* are provided at an equal interval in the circumferential direction of the protruding wall 36 in FIG. 3F, the number of the protrusions 36*d* may be changed at will.

Figure 3C:
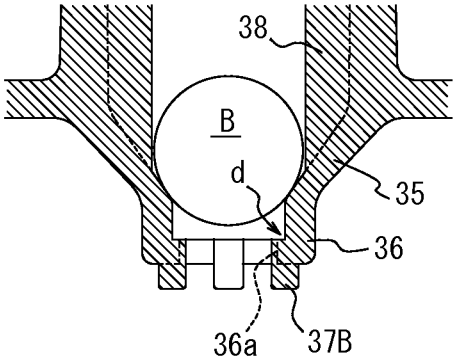
FIG. 3C is a partially enlarged sectional view of a double container according to yet another embodiment of the present disclosure.

Moreover, as illustrated in FIG. 3C, the rib 37B illustrated in FIG. 3A, in addition to the protrusion 36*a* illustrated in FIG. 3B, may be provided. In this case, the rib 37B prevents the pool of the liquid medium from swinging. Besides, as the stepped portion d, a portion that is formed over the entire circumference by the inner circumferential surface of the protruding wall 36 and the protrusion 36*a*, and a portion that is formed by the upper end surface of the rib 37B and that partially protrudes radially inward are additionally provided. As a result, the pool of the liquid medium is held even more stably. Additionally, in the case of FIG. 3A also, the upper end surface of the rib 37B may serve as the stepped portion d.

Figure 3D:
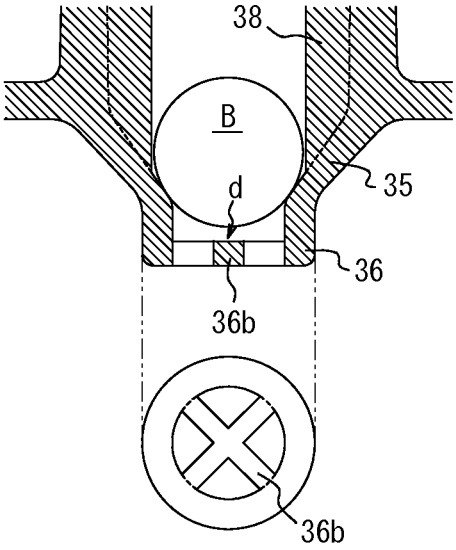
FIG. 3D is a partially enlarged sectional view of a double container according to yet another embodiment of the present disclosure.

Moreover, as illustrated in FIG. 3D, a bridge portion 36*b* may be provided to be bridged between portions of the inner circumferential surface of the protruding wall 36 by extending portions of the protrusion 36*a* illustrated in FIG. 3B to an inner side in the radial direction. In this case, an upper end surface of the bridge portion 36*b* may serve as the stepped portion d. Although in the illustrated example the bridge portion 36*b*, in a bottom view thereof, has a cross shape, the bridge portion 36*b* may also have a radial shape or a straight line shape.

Figure 3E:
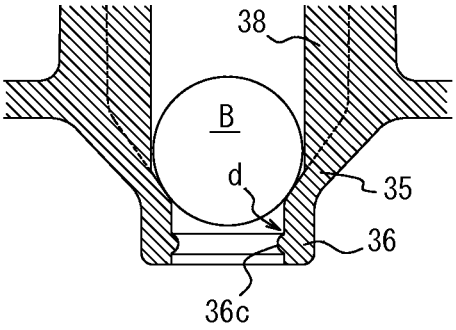
FIG. 3E is a partially enlarged sectional view of a double container according to yet another embodiment of the present disclosure.
Figure 3F:
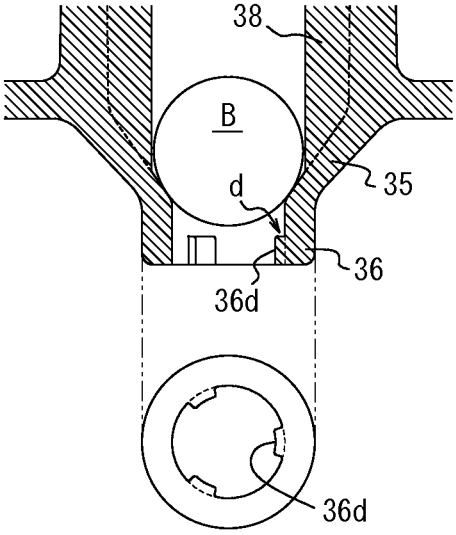
FIG. 3F is a partially enlarged sectional view of a double container according to yet another embodiment of the present disclosure.
Figure 4A:
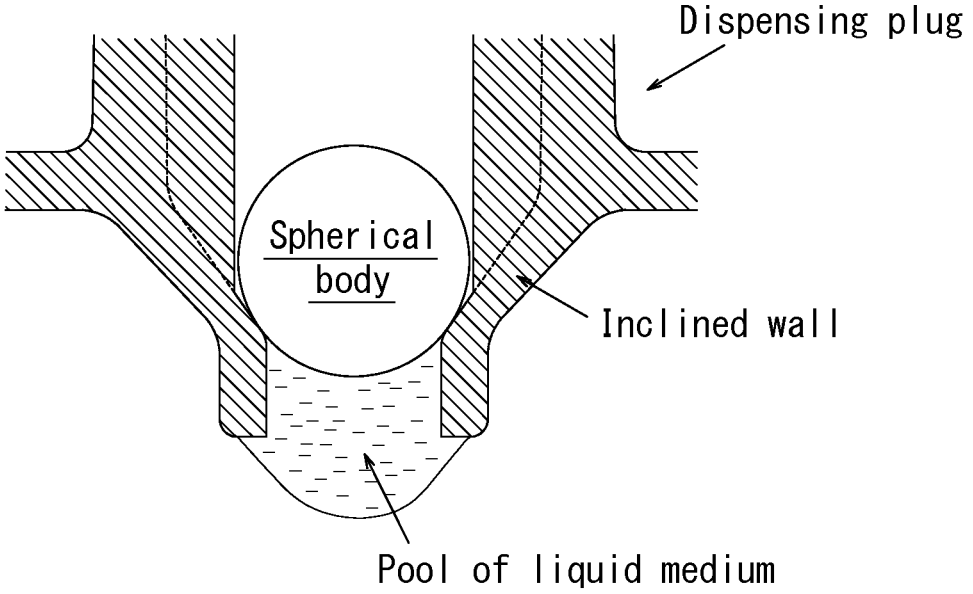
FIG. 4A illustrates a pool of a liquid medium formed in a conventional container in a normal state.
Figure 4B:
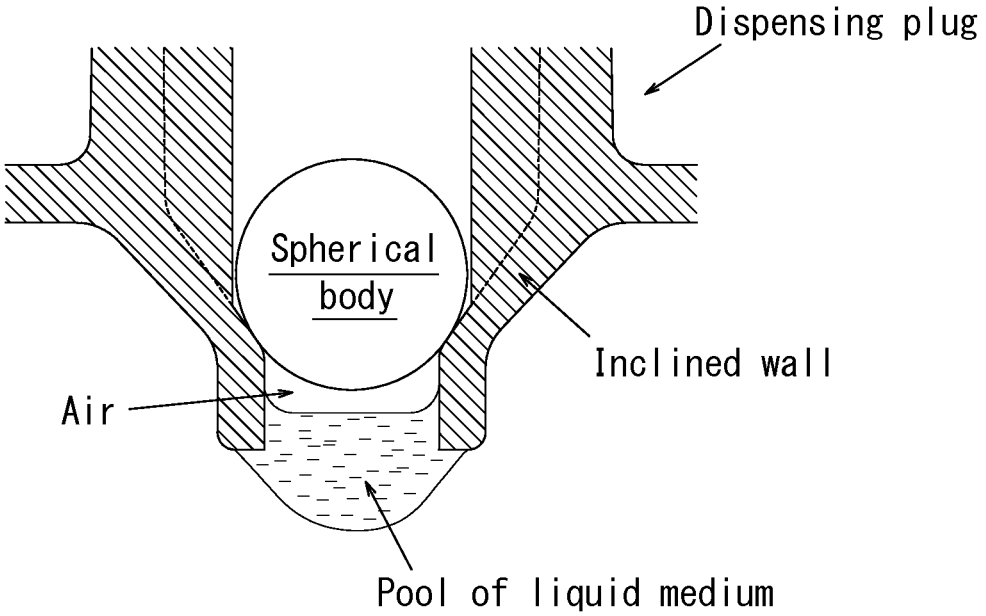
FIG. 4B illustrates a state in which a portion of the pool of the liquid medium has dripped.

Moreover, as illustrated in FIG. 3E, the stepped portion d may be formed by providing an annular protruding ridge 36*c* protruding from the inner circumferential surface of the protruding wall 36 so that the annular protruding ridge 36*ca* in a longitudinal section thereof has an arch shape. The protruding ridge 36*c* may be provided in plurality at an interval in the vertical direction or may be provided in a helical shape. The protruding ridge 36*c* does not need to be provided continuously in the circumferential direction and may also be provided intermittently by cutting out some portions.

The spherical body B has a dimension that is preferably as small as possible to reduce cost. Nevertheless, as the dimension becomes smaller, a contacting area with the inclined wall 35 becomes closer to an outer side of the spherical body B in the radial direction, and therefore, depending on variation in the inside plug 30 and the spherical body B, the spherical body B might drop down to the containing space S. On the other hand, when an inner diameter of a portion of the inclined wall 35 that is located on a front end side thereof is reduced in accordance with the dimension of the spherical body B, a passage of the content is inevitably narrowed, and this hinders smooth discharging of the content. Even in such circumstances, providing the protrusion 36*d* intermittently as illustrated, for example, in FIG. 3F allows the content to be discharged between adjacent protrusions 36*d*. Accordingly, the passage of the content is not narrowed significantly, and the dropping of the spherical body B is effectively prevented.

INDUSTRIAL APPLICABILITY

According to the present disclosure, the pool of the liquid medium formed below the spherical body, which serves as a valve body, is held stably. Accordingly, a novel double container that is capable of effectively preventing dispensing failure occurring due to drying of an abutting surface between the valve body and the inclined wall.

REFERENCE SIGNS LIST

1 double container
10 outer layer body
11 mouth portion
12 trunk portion
13 male screw portion
20 inner layer body
21 upper opening
30 inside plug
31 tubular wall
32 annular wall
33 flange portion
34 sealing wall
35 inclined wall
36 protruding wall
36*a* protrusion
36*b* bridge portion
36*c* protruding ridge
36*d* protrusion
37A, 37B rib (liquid holding member)
38 longitudinal rib
39 convex portion
40 dispensing plug
41 dispensing tube
42 ceiling wall
43 outer circumferential wall
44 female screw portion
50 cap body
51 top wall
52 circumferential wall
53 hinge
54 sealing tube
55 pin
B spherical body
M pool of liquid medium
S containing space
d stepped portion (liquid holding member)

The invention claimed is:

1. A double container, comprising:

an outer layer body serving as an outer shell of the double container;

an inner layer body (i) that includes an upper opening communicating with a containing space configured to hold content of the double container, (ii) that is accommodated in the outer layer body, and (iii) that is deformable to undergo volume reduction;

an inside plug, located in the upper opening, that includes a tubular wall extending toward the containing space, a spherical body serving as a valve body being disposed inside the tubular wall; and a dispensing plug, fitted to a mouth portion of the outer layer body to cover the inside plug, that includes a dispensing tube connected to the tubular wall, wherein:

the tubular wall includes an inclined wall, configured to abut against the spherical body over an entire circumference, that has a diameter decreasing toward the containing space, the tubular wall also includes a cylindrical protruding wall protruding from the inclined wall to the containing space, the protruding wall including a liquid holding member configured to hold a pool of a liquid medium of the content formed below the spherical body, and the liquid holding member comprises a plurality of ribs extending from the protruding wall to the containing space.

2. The double container of claim 1, wherein the plurality of ribs are arranged at an equal interval in a circumferential direction of the tubular wall.

3. A double container, comprising:

an outer layer body serving as an outer shell of the double container;

an inner layer body (i) that includes an upper opening communicating with a containing space configured to hold content of the double container, (ii) that is accommodated in the outer layer body, and (iii) that is deformable to undergo volume reduction;

an inside plug, located in the upper opening, that includes a tubular wall extending toward the containing space, a spherical body serving as a valve body being disposed inside the tubular wall; and a dispensing plug, fitted to a mouth portion of the outer layer body to cover the inside plug, that includes a dispensing tube connected to the tubular wall, wherein:

the tubular wall includes an inclined wall, configured to abut against the spherical body over an entire circumference, that has a diameter decreasing toward the containing space, the tubular wall also includes a cylindrical protruding wall protruding from the inclined wall to the containing space, the protruding wall including a liquid holding member configured to hold a pool of a liquid medium of the content formed below the spherical body, and the liquid holding member comprises, spaced from the spherical body, a stepped portion provided on an inner circumferential surface of the protruding wall.

4. The double container of claim 3, wherein the stepped portion has an annular or a helical shape extending in a circumferential direction of the protruding wall.

5. The double container of claim 3, wherein the stepped portion is provided intermittently in a circumferential direction of the protruding wall.

* * * * *